United States Patent [19]

Narlow et al.

[11] 4,281,321

[45] Jul. 28, 1981

[54] SURVEILLANCE SYSTEM EMPLOYING A FLOOR MAT RADIATOR

[75] Inventors: Douglas A. Narlow; James G. Farrar, both of Coral Springs, Fla.

[73] Assignee: Sensormatic Electronics Corporation, Deerfield Beach, Fla.

[21] Appl. No.: 157,848

[22] Filed: Jun. 9, 1980

[51] Int. Cl.[3] ..... G08B 13/24

[52] U.S. Cl. ..... 340/572; 340/552

[58] Field of Search ..... 340/572, 552

[56] References Cited

U.S. PATENT DOCUMENTS

| | | | |
|---|---|---|---|
| 3,493,955 | 2/1970 | Minasy | 340/572 |
| 3,500,373 | 3/1970 | Minasy | 340/572 |
| 3,868,669 | 2/1975 | Minasy | 340/572 |
| 3,891,980 | 6/1975 | Lewis et al. | 340/572 |
| 3,895,368 | 7/1975 | Gordon et al. | 340/572 |
| 4,095,214 | 6/1978 | Minasy | 340/572 |
| 4,135,184 | 1/1979 | Pruzick | 340/572 |

*Primary Examiner*—Glen R. Swann, III

*Attorney, Agent, or Firm*—Watson, Leavenworth, Kelton & Taggart

[57] ABSTRACT

A floor mat consisting of a conductive grid laminated to a conductive sheet with a layer of dielectric material therebetween to form a capacitor is disposed between the pedestals that house means for radiating a microwave signal through a surveillance area. A low frequency signal is applied to the capacitor mat for direct capacitive coupling through the body of a pedestrian to any surveillance tag carried thereon.

7 Claims, 6 Drawing Figures

Fig. 1.
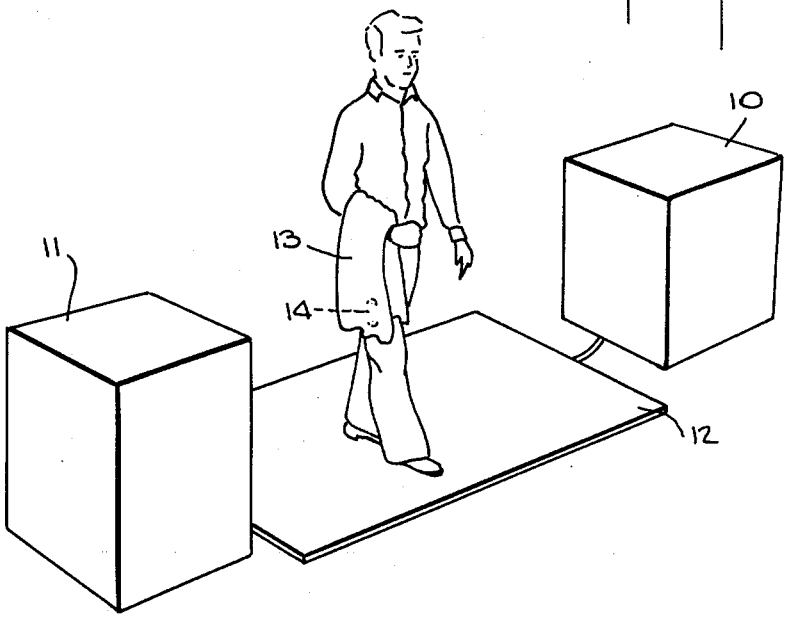
Fig. 3.
Fig. 2.
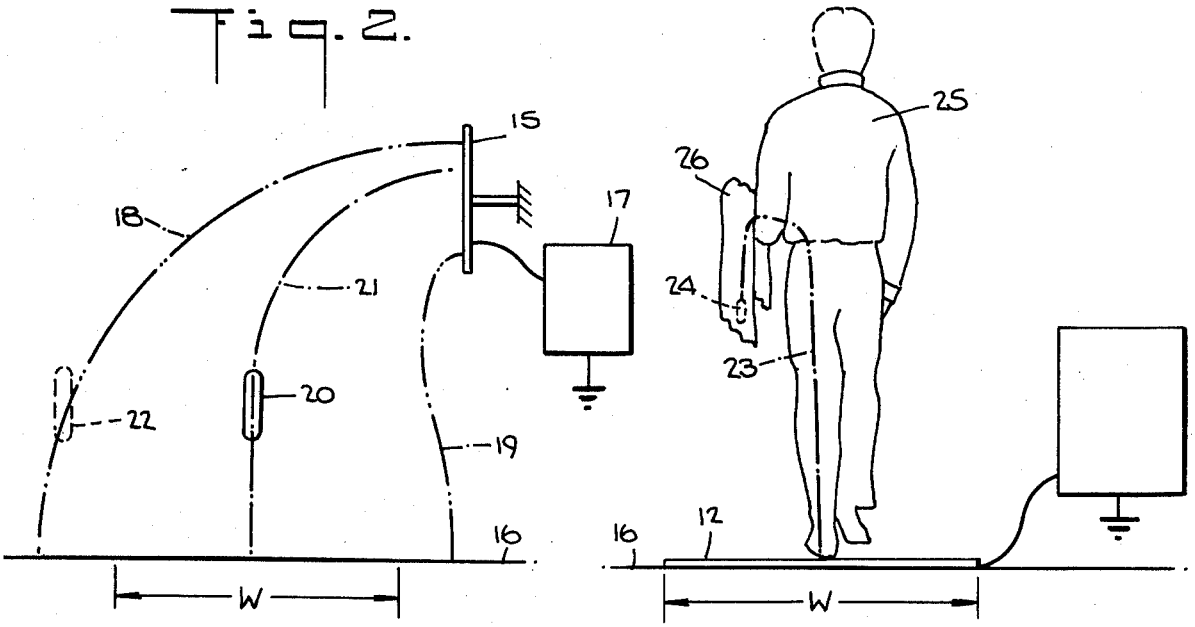

SURVEILLANCE SYSTEM EMPLOYING A FLOOR MAT RADIATOR

BACKGROUND OF THE INVENTION

The present invention relates to apparatus for pilferage control. More particularly, it is directed to apparatus for detecting the presence of a telltale element in an unauthorized zone.

For the purpose of controlling pilferage, it has been proposed heretofore to secure specially constructed tags to the articles to be protected which tags must be deactivated or removed for authorized removal of the articles from the controlled area. In U.S. Pat. No. 3,895,368 issued to Lloyd L. Gordon and Robert D. Williamson for "Surveillance System and Method Utilizing Both Electrostatic and Electromagnetic Fields", and assigned to the same assignee as the present application, there is described apparatus in which a microwave signal generator projects an electromagnetic wave into a space under surveillance to establish a first field. A pulse or frequency modulated low frequency generator is used to apply a voltage to a discontinuous conductor for establishing a second field, electrostatic in nature, throughout the space. Presence in the space of a miniature, passive, electromagnetic wave receptor-reradiator in the form of a semi-conductive diode connected to a dipole antenna causes the reradiation of the low frequency component modulated on the microwave component as a carrier. The front end of a receiver system is tuned to the microwave frequency signal. A coincidence circuit energizes an alarm circuit whenever the detected signal coincides with the original modulation envelope being applied to the low frequency generator. The patent contains a general statement that the discontinuous conductor may be extended across the areaway being protected and that a grounded conductor may be located in the floor in order to provide a return path for the electrostatic signals, if necessary. In a preferred embodiment, described in said patent, pedestals are located on opposite sides of the areaway to be protected which pedestals contain foil elements for establishing the electrostatic field. In a specific example, the foil elements are mentioned as being 4"×4" in size, and energized by a 245 V RMS signal.

It has been found, however, that when the electrostatic field radiators are located in the side pedestals above the floor level, it is difficult to confine the electrostatic field to the precise area desired to be controlled between the pedestals. When the radiated energy extends beyond the desired boundaries, it is referred to as over-ranging. Over-ranging is undesirable since it cuts down on the floor space adjacent the controlled areaway where tagged articles can be located legitimately or may be transported by someone without tripping an alarm.

SUMMARY OF THE INVENTION

The present invention provides apparatus of the type described in the aforesaid patent in which over-ranging due to the inability to confine the electrostatic field to the desired space has been greatly reduced, if not eliminated. In accordance with the invention there is provided a surveillance system for detecting the presence in a controlled space of a miniature electromagnetic wave receptor-reradiator with signal mixing capability which system comprises in combination means for propagating through said space an electromagnetic microwave signal, a source of low frequency signals, an electrode coupled to said source of low frequency signals for disposition along the path of travel of said receptor-reradiator through said space for direct capacitive coupling to said receptor-reradiator whenever the latter is present in said space, signal detecting means coupled to said space for receiving signals therefrom and detecting signals to said low frequency signals only when received as modulation on a carrier signal whose frequency bears a predetermined relationship to that of said microwave signals, and means coupled to said detecting means for providing an alarm responsive to detection of said signals that are related to said low frequency signal.

BRIEF DESCRIPTION OF THE DRAWINGS

The invention will be better understood after reading the following detailed description of the presently preferred embodiments thereof with reference to the appended drawings in which:

FIG. 1 is a perspective view of an installation embodying the present invention;

FIG. 2 is a diagrammatic illustration useful in furnishing an explanation of the wave field produced by the prior art system;

FIG. 3 is another diagrammatic view similar to FIG. 2 but illustrating the operation of the present invention;

The same reference numerals are used throughout the drawings to designate the same or similar parts.

DESCRIPTION OF THE PREFERRED EMBODIMENTS

Figure 4:
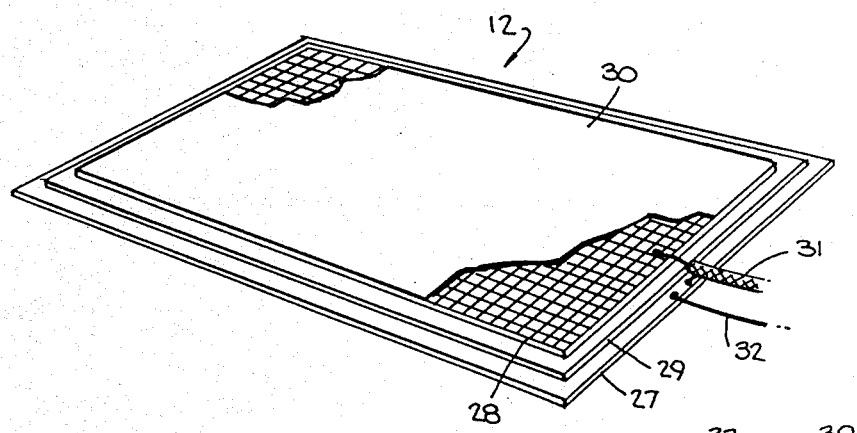
FIG. 4 is a perspective view of an electrode structure in the form of a floor mat for use in the system of FIG. 1.

Referring now to the drawings, there is shown in FIG. 1 a typical installation consisting of pedestals 10 and 11 disposed on opposite sides of a passageway to be controlled. For example, the passageway may be at the exit from a retail establishment to insure that merchandise is not removed from the retail space without authorization. Disposed on the floor between the pedestals 10 and 11 is a mat 12 on which the pedestrian, here a customer, must tread when passing through the controlled space. In the illustration, an individual is shown attempting to pass between the pedestals 10 and 11 carrying an article of merchandise 13 to which is affixed a receptor-reradiator device 14. In the illustrated circumstance, it is desired that the system provide an alarm in order that the pilferer may be intercepted.

In the prior system described in the aforesaid patent, the electrostatic field electrode 15 (see FIG. 2) is located preferably on either one or both sides of the passageway to be controlled at some distance above the floor 16. The electronic circuitry 17 for energizing the electrode 15 would be grounded, as shown in FIG. 2, causing an electrostatic field to be developed between the electrode 15 and the floor 16 that is bounded by the broken lines 18 and 19. For purpose of illustration, it is assumed that the boundaries 18 and 19 lie beyond the desired width W, of the area to be protected. When a receptor-reradiator in the form of a tag 20 enters the space, the energy path linking the tag 20 with the detecting system might coincide with the phantom line 21. It will be appreciated that another tag outside of the boundaries of the area to be protected, such as at 22, would also be linked by the electrostatic field and cause the alarm to be energized.

In accordance with the present invention the electrode for producing the electrostatic field is located on the floor as shown in FIG. 1 and cooperates with the receptor-reradiator as shown schematically in FIG. 3. In view of the fact that in general a surveillance tag can be introduced into the controlled space only by being carried therein by a pedestrian, it will be appreciated that a capacitor electrode in the mat 12 will become directed coupled capacitively via the path 23 with the receptor-reradiator 24 through the body of the individual 25 and the merchandise 26 on the person's arm. Because of the direct capacitive coupling to anything coming in contact with the mat 12, the erergizing power supplied to the mat can be reduced significantly below that which must be furnished to the electrode 15 in the system of FIG. 2. Hence, the electrostatic field can be confined to substantially the boundary of the mat 12 with inconsequential spillage or over-ranging beyond its perimeter.

Figure 5:
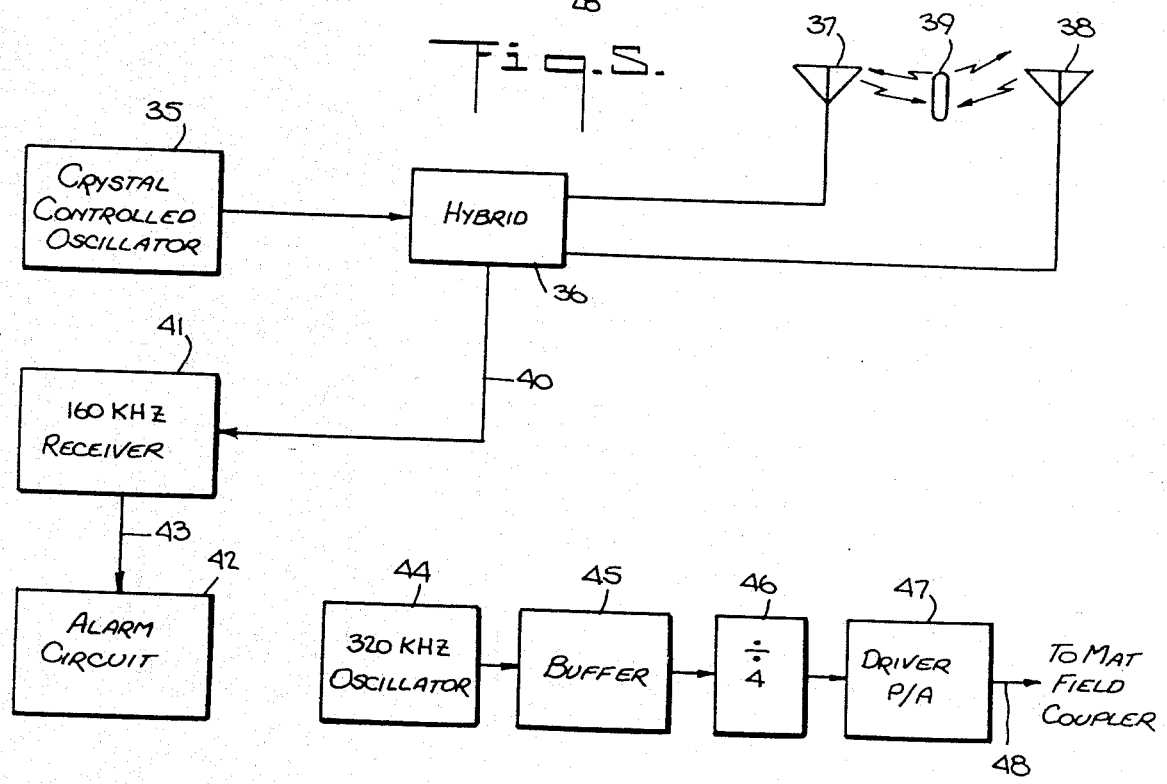
FIG. 5 is a block diagram of a typical circuit for use with the electrode of FIG. 4 in the system of FIG. 1.

The details of the mat 12 will now be described with reference to FIG. 4 to which attention should be directed. As seen therein, the mat 12 consists of a conductive ground plane sheet 27, an open grid electrode layer 28, and a layer of dielectric material 29 sandwiched between the grid 28 and the conductive sheet 27. A top coating layer 30 of insulating material completely covers the grid structure 28 but is pictured broken away at the corners to reveal the underlying grid structure. A coaxial or shielded cable 31 has its central conductor connected to the grid electrode 28 while its shield is connected to the ground plane conductor 27. A separate grounding wire 32 may be connected directly to the sheet 27. Further details of the mat 12 will be described below after describing the control circuitry in FIGS. 5 and 6 to which reference should now be had.

Figure 6:
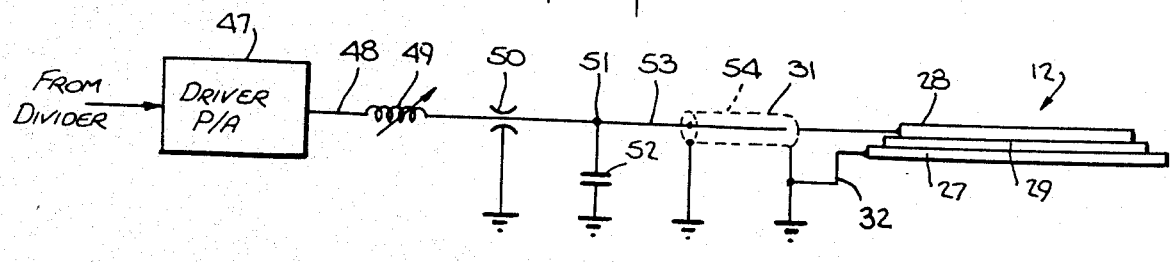
FIG. 6 is a fragmentary, schematic diagram of a further detail of the circuit of FIG. 5.

A crystal controlled oscillator 35 feeds a hybrid circuit 36 which, in turn, feeds two radiating antenna structures 37 and 38 for progagating through the space to be controlled an electromagnetic microwave signal. Such signal may be at a frequency of 915 megahertz. When a receptor-reradiator 39 is present in the space between the antennas 37 and 38 it will be linked by the energy radiated therefrom and a reradiated component of the signal will be received by the same antennas 37 and 38 and fed back to the hybrid circuit 36. Incoming signals reaching the hybrid circuit 36 will leave over the output path 40 to an input of a receiver 41 arranged to detect signals at a frequency of 160 kilohertz. If such signals are detected having a particular characteristic, an alarm circuit 42 connected to an output of the receiver 41 over a path 43 will be energized. As mentioned previously, it is necessary for a low frequency signal to be modulated upon the microwave carrier signal in order to energize the alarm circuit. For this purpose, there is also provided a low frequency signal source, which in the present example is shown as consisting of a 320 kilohertz oscillator 44 whose output is connected through a buffer amplifier 45 to a circuit 46 for dividing the frequency by four and feeding a driver, power amplifier circuit 47. Thus, a signal of 80 kilohertz will appear at the output of the driver, power amplifier 47 to be coupled over a path 48 to the capacitor mat. As shown in FIG. 6 the output of the driver, power amplifier 47 is connected through an adjustable inductor 49 and a feedthrough 50 to a junction 51. A precision capacitor 52 is connected between the junction 51 and ground. The selection of the capacitor 52 depends upon the capacitance of the mat 12 to be driven by the system. Also connected to the junction 51 is the center conductor 53 of a length of shielded cable 31 whose shield 54 is grounded as shown. The other end of the conductor 53 is connected to the grid electrode 28 of the mat 12, while the ground plane sheet 27 is connected to ground as shown. It will be understood by those skilled in the art that the inductance of inductor 49 can be adjusted to resonate with the total capacitance represented by mat 12, shielded cable 31, capacitor 52, and feedthrough 50. For purposes of illustration there is tabulated below various mat dimensions and capacitances that have been found suitable for use in an embodiment of the present invention.

| Dimension Of Mat | Capacitance - pf. | |
|---|---|---|
| | Mat | Cap. 52 |
| 20" × 20" | 1538 | 2450 |
| 20" × 26" | 2000 | 1988 |
| 26" × 32" | 3200 | 788 |

The feedthrough 50 has capacitance to ground of about 2 pf., while the shielded cable may be 2 ft. long and have a stray capacitance of about 30 pf./ft. The nominal inductance of inductor 49 is about 978 μh. Thus, the total capacitance between ground and inductor 49 is about 4050 pf.

It is preferred to employ a grid or other open-work element for electrode 28 in order to obtain increased size without unduly increasing the capacitance of the structure. In the present examples use is made of an aluminum grid having an open area equal to about 64% of the grid dimension. The mat sizes listed above can be used between pedestals spaced apart from about 24" to about 39" with the particular mat size chosen that best fits the interpedestal spacing.

When a tag is present in the controlled space, it will cause the carrier signal received from antennas 37 and 38 to be modulated at least by the second harmonic of the signal furnished to the mat 12. That is, an 80 kilohertz signal is fed to the tag which causes a 160 kilohertz signal to be modulated on the carrier signal for detection by receiver 41. Additional modulation or variation of the surveillance signals may be incorporated in the system to aid in suppression of false alarms. However, such modifications form no part of the present invention and need not be described.

Having described the presently preferred embodiments of the subject invention it will be understood that various changes in construction can be incorporated without departing from the true spirit of the invention as defined in the appended claims.

What is claimed is:

1. A surveillance system for detecting the presence in a controlled space of a miniature electromagnetic wave receptor-reradiator with signal mixing capability, comprising in combination means for propagating through said space an electromagnetic microwave signal, a source of low frequency signals, an electrode coupled to said source of low frequency signals for disposition along the path of travel of said receptor-reradiator through said space for direct capacitive coupling to said receptor-reradiator whenever the latter is present in said space, signal detecting means coupled to said space for receiving signals therefrom and detecting signals related to said low frequency signals only when received as modulation on a carrier signal whose frequency bears a predetermined relationship to that of said microwave signals, and means coupled to said detecting means for providing an alarm responsive to detection of said signals that are related to said low frequency signals.

2. A system according to claim 1, wherein said electrode is a component of a capacitor structure disposed in said space on a floor where a pedestrian passing through said space is compelled to tread thereupon for capacitive coupling thereto.

3. A system according to claim 2, wherein said electrode consists of a conductive grid, and is laminated to a conductive sheet with a layer of dielectric material therebetween, and said source of low frequency signals is coupled between said grid and said conductive sheet.

4. A system according to claim 3, wherein said conductive grid is covered with a layer of insulating material.

5. A system according to claim 4, wherein the capacitance between said grid and said conductive sheet of said capacitor structure lies within the range of about 1,538 to about 3,200 picofarads.

6. A system according to claim 2, wherein said capacitor structure is connected to the output of said source of low frequency signals in a series circuit that is tunable to resonance.

7. A system according to claim 2, wherein said source of low frequency signals is constructed to supply said capacitor structure with a signal having a first frequency, said receptor-reradiator is constructed to mix said first frequency with said microwave signal so as to produce second or higher harmonics of said first frequency as modulation superimposed on a carrier signal whose frequency bears a predetermined relationship to that of said microwave signals, and said signal detecting means is constructed to detect said harmonics of said low frequency signals.

* * * * *